US006240871B1

(12) United States Patent
Courtheyn

(10) Patent No.: US 6,240,871 B1
(45) Date of Patent: Jun. 5, 2001

(54) SECURE MOORING CONNECTION ANCHOR

(75) Inventor: Steven M. Courtheyn, 626 Marnell Ave., Santa Cruz, CA (US) 95065

(73) Assignee: Steven M. Courtheyn, Aptos, CA (US)

( * ) Notice: Subject to any disclaimer, the term of this patent is extended or adjusted under 35 U.S.C. 154(b) by 0 days.

(21) Appl. No.: 09/420,147

(22) Filed: Oct. 18, 1999

(51) Int. Cl.[7] ..... B63B 21/32
(52) U.S. Cl. ..... 114/301
(58) Field of Search ..... 114/294, 300, 114/301, 302, 303, 304, 309, 307; D12/215

(56) References Cited

U.S. PATENT DOCUMENTS 4,337,717 * 7/1982 Gregory ..... 114/294
4,785,758 * 11/1988 Eichelberger, Sr. ..... 114/301
5,529,023 * 6/1996 Boardman ..... 114/303

* cited by examiner

*Primary Examiner*—Ed Swinehart

(57) ABSTRACT

An anchor comprising a shank having a forward and a rear end with a plurality of flukes secured to the rear end of the shank. The plurality of flukes are secured to the shank by a fluke mounting element. The plurality of flukes are radially oriented and angularly spaced apart and positioned on the fluke mounting element. A plurality of arm elements are radially aligned and oriented with respect to the fluke mounting element. Each of the plurality of flukes may be provided with an inwardly sloped bill segment at a distal end thereof.

1 Claim, 3 Drawing Sheets

SECURE MOORING CONNECTION ANCHOR

BACKGROUND OF THE INVENTION

1. Field of the Invention

This invention relates to anchors for marine use and other aquatic uses, and in particular to anchors having multiple flukes and multiple arm elements.

2. Description of Related Art

Many different anchor types have been proposed and implemented for holding a boat in a particular place by means of a fluke which digs into the bottom of an ocean, lake, or river. Numerous shapes of anchors have been proposed including grapnel, "A" frame, yachtsman's, mushroom, and Danforth (limited pivoting fluke).

One serious limitation of prior anchors, and in particular the Danforth type of anchor is that they have a tendency to roll in the direction of a sideways pull, such as which may occur with a shift of wind, tide, or current. Such a roll is often the precursor of one or both of the flukes breaking out of the sea floor. Often the anchor in such situations fails to reset itself, and skates along on the edge of one fluke and the shackle end of the shank.

Although there have been prior attempts to solve the problem of anchor rolling and breakout by providing various modifications and accessories to conventional anchors, all such attempts have been cumbersome, un eliable, and ill-suited for serious use. Such limitations. have undoubtedly been a reason such anchor modifications have not received widespread acceptance.

It is of critical importance for an anchor to have the ability to catch and grab on uneven ground. The present invention provides a very simple yet extremely efficient and reliable solution to such limitations in prior anchors. Accordingly, it is the primary object of this invention to provide an anchor with a plurality of radially oriented and angularly spaced flukes which are combined with a plurality of radially aligned and oriented arm elements to provide quick and considerable grip and holding potential. Because of its unique configuration the anchor of the present invention also has a minimum level of dragging and fouling when pivoting and/or swinging with the change of tides and winds.

Additional objects and advantages of the invention will be set forth in the description which follows, and in part will be obvious from the description, or may be learned by practice of the invention. The objects and advantages of the invention may be realized and obtained by means of the instrumentality's and combinations particularly pointed out in the appended claims.

SUMMARY OF THE INVENTION

To achieve the foregoing objects, and in accordance with the purposes of the invention as embodied and broadly described herein an anchor comprising a shank having a forward and a rear end has a plurality of flukes secured to the rear end of the shank. The plurality of flukes are secured to the shank by a fluke mounting element. The plurality of flukes are radially oriented and angularly spaced apart and positioned on the fluke mounting element. A plurality of arm elements are radially aligned and oriented with respect to the fluke mounting element. Each of the plurality of flukes may be provided with an inwardly sloped bill segment at a distal end of the fluke.

BRIEF DESCRIPTION OF THE DRAWINGS

The accompanying drawings, which are incorporated in and constitute a part of the specification, illustrate a preferred embodiment of the invention and, together with a general description given above and the detailed description of the preferred embodiment given below, serve to in the principles of the invention.

FIG. show a perspective view of a secure mooring connection anchor, according to the invention

DETAILED DESCRIPTION OF THE PREFERRED EMBODIMENTS

Reference will now be made in detail to the present preferred embodiments of the invention as illustrated in the accompanying drawings.

In accordance with the present invention, there is provided an anchor comprising a shank having a forward and a rear end with a plurality of flukes secured to the rear end of the shank. The plurality of flukes are secured to the shank by a fluke mounting element. The plurality of flukes are radially oriented and angularly spaced apart and positioned on the fluke mounting element. A plurality of arm elements are radially aligned and oriented with respect to the fluke mounting element. Each of the plurality of flukes may be provided with an inwardly sloped bill segment at a distal end thereof. The flukes may be provided in a fixed or adjustable configuration.

Figure 1:
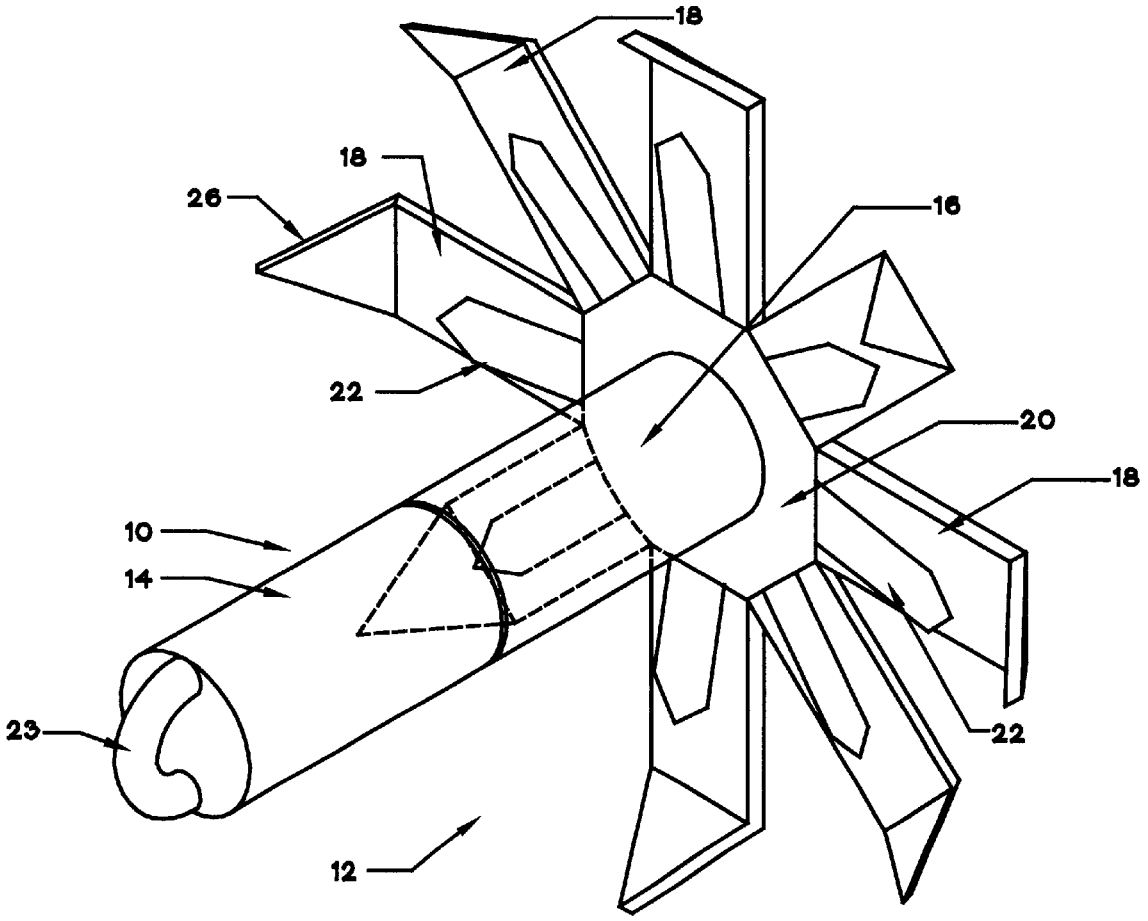

In FIG. 1, a secure mooring connection anchor 10 is shown according to a preferred embodiment of the invention. Anchor 10 includes a shank 12 with a forward end 14 and a rear end 16. Shank 12 may be variously configured, for example, cylindrical or rectangular, or other configurations well known in the art. A plurality of flukes 18 are secured to rear end 16 of shank 12. Preferably the plurality of flukes 18 are secured to shank 12 by a fluke mounting element 20, sometimes referred to in the art as an anchor crown, which may be variously configured and provided, for example, as a expanded late-like member as shown, or alternatively, be a fastening element for securing flukes 18 to shank 12. Examples of fastening elements include a weld, a molded one piece unit, bolts, screws or the like. However, a fluke mounting element 20, configured as seen in FIG. 1, or similarly, is preferred.

Figure 2:
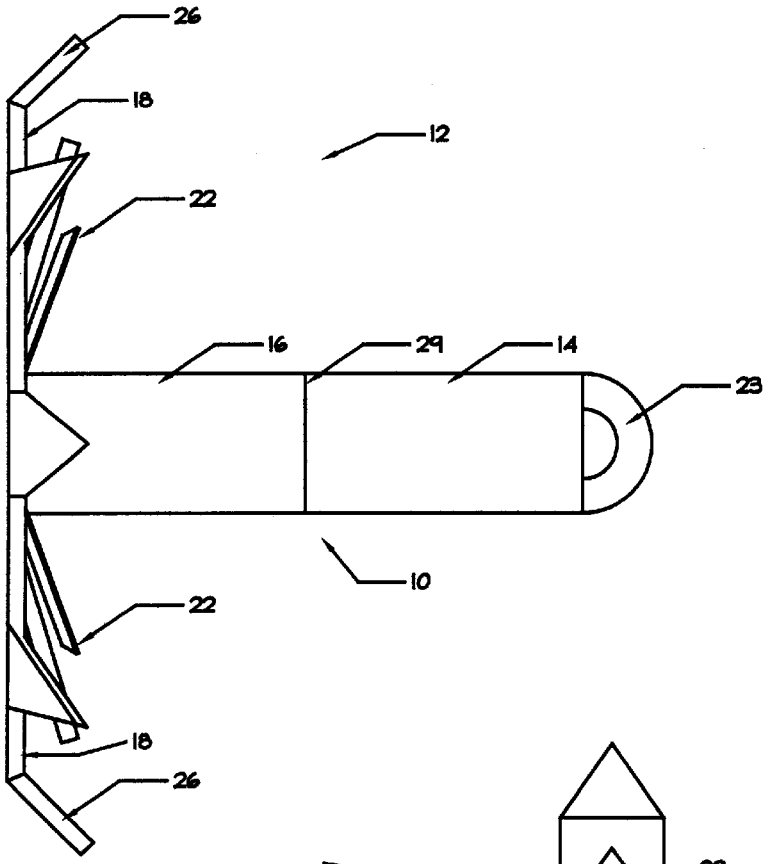
FIG. 2 shows a side view of such anchor, according to the invention.
Figure 3:
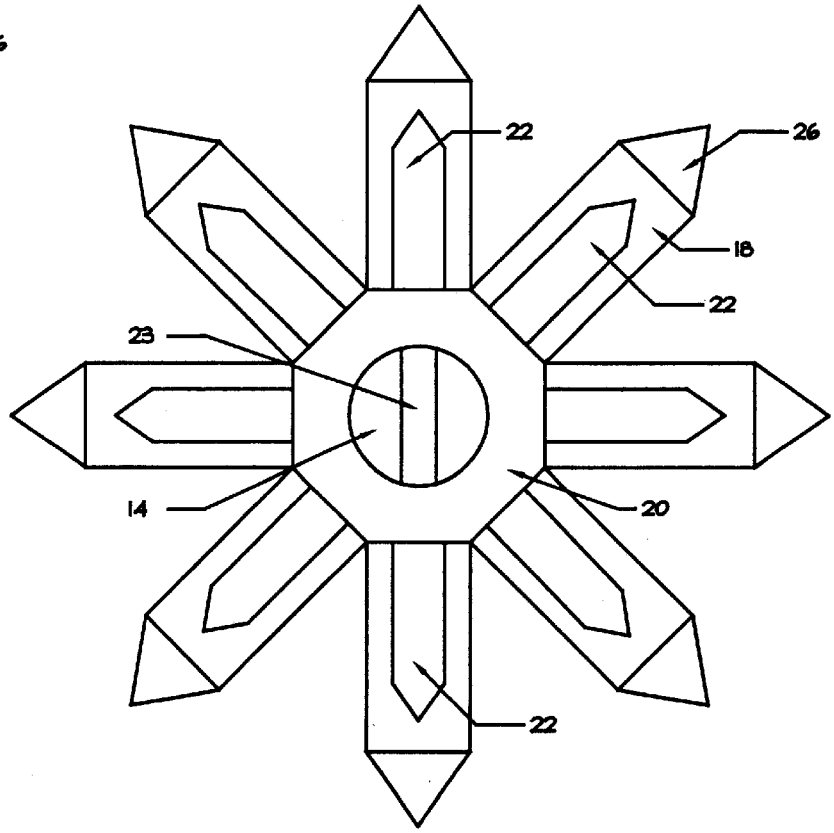
FIG. 3 shows a front view of such anchor, according to the invention.

The plurality of flukes 18, as seen in FIGS. 1, 2 and 3, are preferably radially oriented with respect to shank 12, and angularly spaced apart and positioned on fluke mounting element 20, or alternatively to shank 12. Flukes 18 are preferably composed of a durable resilient material such a metal. In a preferred embodiment, flukes 18 are configured with a inwardly sloped bill segment 24 at a distal end 26 of flukes 18. Of course, various bill and fluke configurations may be provided, and the slope, angle, and size of bill 24 may alter depending on the embodiment.

As seen in FIGS. 1, 2, and 3 a plurality of arm elements 22 are radially aligned and oriented in respect to shank 12, and preferably one arm element is aligned with each of the plurality of flukes 18. In different embodiments, however, it is possible to have some flukes without a corresponding arm element, or to have some or all of the arm elements not in corresponding alignment with the flukes.

Figure 4:
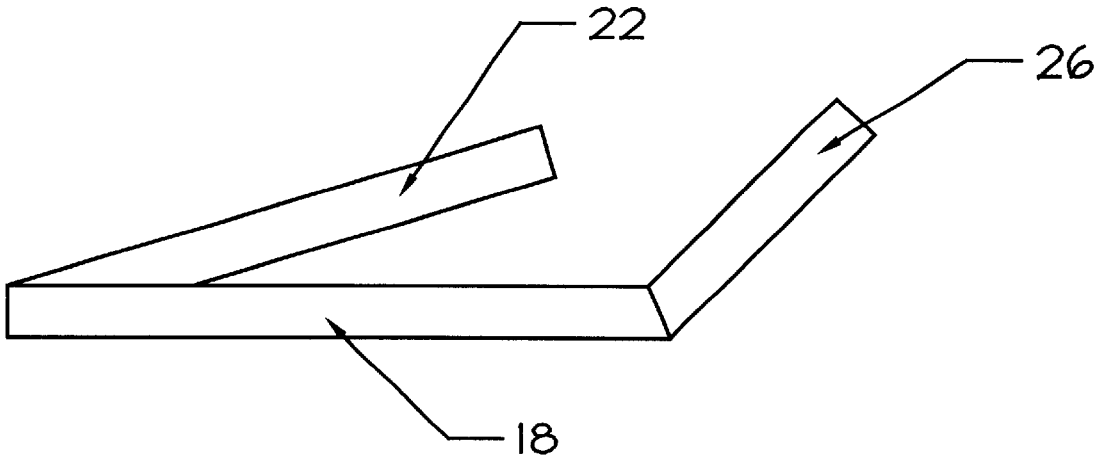
FIG. 4 a top view of the end portion of an arm element, according to the invention.
Figure 5:
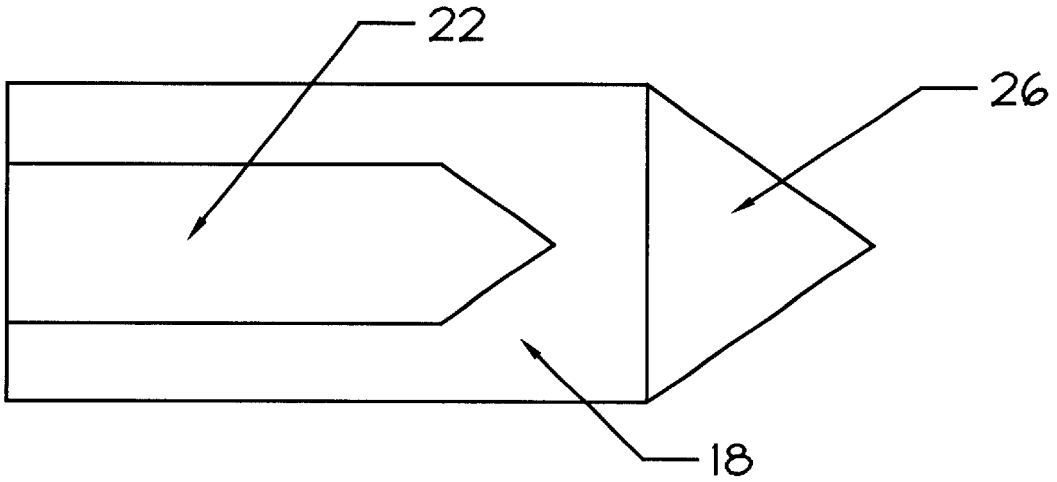
FIG. 5 shows a top portion of the end of an arm element, according to another embodiment of the invention.

With reference now to FIG. 4, a preferred configuration of an arm element 22 is shown. In this configuration a pointed tip and substantially triangular or pointed end is provided. In FIG. 5, another fluke and arm configuration and arrangement is shown, with arm 22 upwardly curved from fluke 18. Many configurations of flukes 18 and arms elements 22 are possible. Of critical importance is the radial orientation and positioning of the plurality of flukes 18 and the plurality of arm element 22 about shank 12, which provides significant gripping and holding power by the use of multiple flukes and arm elements in a radial configuration.

In operation and use, secure mooring connection anchor 10 is extremely versatile, reliable, easy to use, easy to transport and store, and highly efficient in gripping and holding a boat in position. In use, anchor 10 is used like any conventional anchor. However, because of the configuration of multiple flukes 18 and arm elements 22 very quick gripping and holding power is provided while also having a minimal level of dragging and fouling when pivoting and/or swinging with changes in wind and tide. The plurality of multiple flukes 18 and arm elements 22 allows for both deep rooting qualities and for providing security while riding at anchor. Anchor 10 will remain set securely or resets quickly after swinging at anchor.

Additional advantages and modifications will readily occur to those skilled in the art. The invention in its broader aspects is, therefore, not limited to the specific details, representative apparatus and illustrative examples shown and described. Accordingly, departures may be made from such details without departing from the spirit or scope of the applicant's general inventive concept.

What is claimed is:

1. An anchor, comprising:

a shank having an upper end and a lower end, and defining a shank axis, a plurality of flukes secured to said lower end of said shank, said plurality of flukes being secured to said shank by a fluke mounting element, said plurality of flukes being radially oriented with respect to said shank axis, and angularly spaced apart from each other, a plurality of arm elements equal in number to the number of said flukes, each one of said arm elements being attached to an inner end of one of said flukes and being above and angularly oriented with respect thereto, and as viewed from said shank upper end, each arm being radially aligned with one of said flukes.

* * * * *